United States Patent [19]

Driscoll

[11] 4,028,452

[45] June 7, 1977

[54] ADDITIVES TO IMPROVE WETTABILITY OF SYNTHETIC PAPER PULP

[75] Inventor: Gary L. Driscoll, Boothwyn, Pa.

[73] Assignee: Sun Ventures, Inc., St. Davids, Pa.

[22] Filed: Sept. 25, 1974

[21] Appl. No.: 508,971

Related U.S. Application Data

[62] Division of Ser. No. 415,092, Nov. 12, 1973, abandoned.

[52] U.S. Cl. ..... 264/51; 162/146; 162/157 R; 264/147; 264/230; 264/DIG. 5; 264/DIG. 8; 264/DIG. 47

[51] Int. Cl.[2] ..... B29D 27/00; D21B 1/30

[58] Field of Search ..... 264/51, 53, DIG. 8, 264/DIG. 5, 147, 230, DIG. 47; 162/166

[56] References Cited

UNITED STATES PATENTS

| | | | |
|---|---|---|---|
| 3,003,304 | 10/1961 | Rasmussen | 264/DIG. 8 |
| 3,068,527 | 12/1962 | Morgan | 264/264 DIG. 8 |
| 3,097,991 | 7/1963 | Miller et al. | 264/DIG. 8 |
| 3,129,273 | 4/1964 | Lowes | 264/DIG. 8 |
| 3,210,239 | 10/1965 | Eberl et al. | 264/DIG. 8 |
| 3,403,203 | 9/1968 | Schirmer | 264/DIG. 8 |
| 3,539,666 | 11/1970 | Schirmer | 264/51 |
| 3,549,470 | 12/1970 | Greenwald et al. | 264/DIG. 8 |
| 3,562,369 | 2/1971 | Chopra et al. | 264/DIG. 8 |
| 3,582,418 | 6/1971 | Delft | 264/DIG. 8 |
| 3,586,645 | 6/1971 | Granger et al. | 264/53 X |
| 3,645,085 | 2/1972 | Rassart | 264/DIG. 8 |

FOREIGN PATENTS OR APPLICATIONS

| | | | |
|---|---|---|---|
| 1,157,299 | 7/1969 | United Kingdom | 264/DIG. 8 |
| 1,221,488 | 2/1971 | United Kingdom | 264/DIG. 8 |

*Primary Examiner*—Philip Anderson
*Attorney, Agent, or Firm*—Donald R. Johnson; J. Edward Hess; Anthony Potts, Jr.

[57] ABSTRACT

Synthetic paper pulp is prepared by extruding a foam sheet of a synthetic thermoplastic fiber forming resin, which resin contains from 0.1 to 5.0 wt. % and preferably from 1 to 2 wt. % of a soap such as aluminum stearate, attenuating the foam sheet as it is extruded and applying either heat or a shearing action to the attenuated sheet to cause it to break down into short fibers containing numerous fibrils. This pulp is then either used directly or blended with natural pulp, wet laid to form a coarse paper and then formed into a final paper product by application of heat and pressure. The soap serves to improve the wettability of the resulting fibers.

4 Claims, 1 Drawing Figure

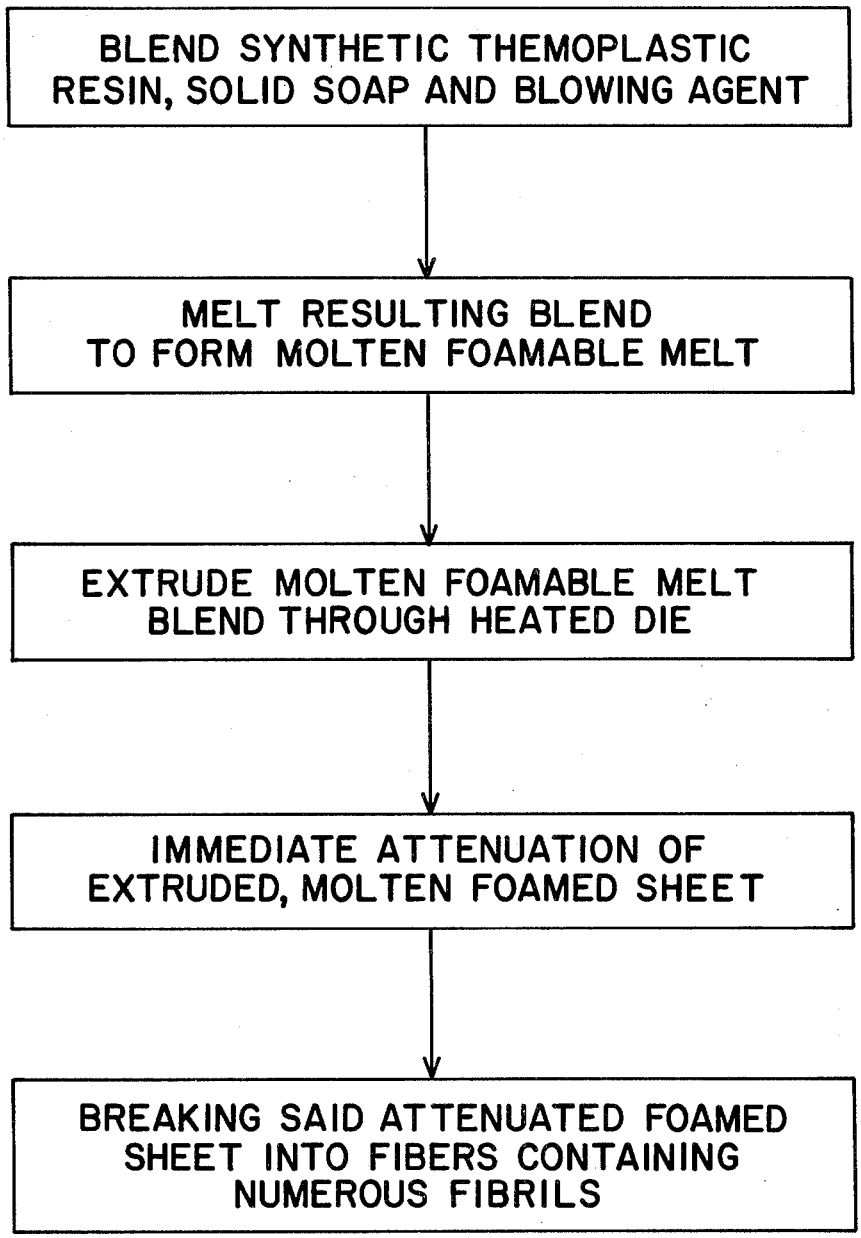
BLEND SYNTHETIC THEMOPLASTIC RESIN, SOLID SOAP AND BLOWING AGENT
MELT RESULTING BLEND TO FORM MOLTEN FOAMABLE MELT
EXTRUDE MOLTEN FOAMABLE MELT BLEND THROUGH HEATED DIE
IMMEDIATE ATTENUATION OF EXTRUDED, MOLTEN FOAMED SHEET
BREAKING SAID ATTENUATED FOAMED SHEET INTO FIBERS CONTAINING NUMEROUS FIBRILS

ADDITIVES TO IMPROVE WETTABILITY OF SYNTHETIC PAPER PULP

This is a division of application Ser. No. 415,092 filed Nov. 12, 1973, now abandoned.

BACKGROUND OF THE INVENTION

In the past a wide variety of synthetic and natural fibers have been used in the paper making process in attempts to improve various physical properties of paper. Recently, increasingly severe local shortages of pulpwood have added impetus to these efforts; because if significant amounts of synthetic fibers can be added to the natural pulp the available pulpwood supply will be extended. For this application a process should be as economical as possible in order to keep the cost of the synthetic pulp close to that of natural pulp. Thus a suitable process should be as simple as possible. In order for the product pulp to be suitable for use in conventional paper making machinery the process should allow for variation in fiber length, cross-section, composition and should make a fibrous structure having many fine fibrils to provide for good interconnection. Because of shipping limitations the process should make a dense product for easy shipping which product is easily converted into fine fibrous form.

SUMMARY OF THE INVENTION

The present invention relates to a process of preparing synthetic pulp from synthetic thermoplastic, fiber-forming resins. The resin is extruded along with a blowing agent and a soap to form a film of the foamed resin. The film is attenuated somewhat as it leaves the extruder die to induce formation of fibers and fibrils. The resulting foamed material is then subjected to a heating or shearing action which results in the foamed material breaking down into small short fibers having many fibrils attached. This synthetic fibrous material readily mixes with natural pulp to allow preparation of paper sheets having varying amounts of the desired synthetic resin or resins. The soap improves the wettability of the fibers which results in their being wet laid into paper more uniformly and also results in improved adhesion of the fibers.

BRIEF DESCRIPTION OF THE DRAWING

The accompanying drawing shows a flow sheet for the process for preparing the fibers containing numerous fibrils of this invention.

DESCRIPTION OF THE INVENTION

The present invention involves extruding a foamable melt of a fiber forming resin and a soap through a slot die to form a foam which is attenuated somewhat and taken up on a stool.

The slot die may be either circular of flat. Practicality and convenience are the only limits to the width or diameter of the die. Generally the slot will be from 5 to 100 mils in thickness. Below about 5 mills the amount of material being extruded becomes so small as to be impractical. Above about 100 mils in thickness the foamed extrudate becomes increasingly difficult to attenuate and to break into fibers.

The foamed extrudate is attenuated as it leaves the die to induce fibril formation. Generally this attenuation is at a rate of from 1.5 to 10 times the rate linear at which the foamable resin is being extruded. This attenuation takes place while the resin is still in the molten or amorphous state.

Any synthetic fiber-forming resin is suitable for use in the present invention. Suitable resins include but are not limited to polyethylene (low, medium or high density), polypropylene, polystyrene, polyvinyl chloride, polyamides, polymethanes, acrylic resins, ethylene vinyl acetate copolymers, polyesters, acrylonitrile-butadiene-styrene resins, ionomer resins, styrene-acrylonitrile copolymers, poly(methacrylonitrile) and mixtures thereof. The optimum conditions used will vary considerably depending on the choice of the polymer system. The length and diameter of the fibers can be controlled by varying the amont of blowing agent used, the temperature both in the extruder and of the quench, the resin through-up gate through the extruder and die, and the amount of attenuation achieved by means of the take off rate.

The extruder used may be equipped with a port to inject the blowing agent. If this is done, various blowing agents may be used such as the various Freons, methylene chloride, nitrogen, carbon dioxide, etc. If the extruder is not equipped with a port to inject the blowing agent the blowing agent is fed into the extruder along with the resin being extruded. While this can be done by coating the resin pellets or powder with a low boiling liquid such as pentane which becomes a gas in the extruder, it is preferred to blend a solid physically or chemically decomposable blowing agent with the resin and then to feed the resulting blend into the extruder. Exemplary chemical agents include but are not limited to azobisformamide, azobisisobutyronitrile, diazoaminobenzene, 4,4′-oxybis(benzenesulfonylhydrazide), benzenesulfonylhydrazide, N,N′-dinotrazopentamethylenete ramine, trihydrazinosymtriazine, p,p′-oxybis(benzenesulfonylsemicarbazide)-4-nitrobenzene sulfonic acid hydrazide, beta-naphthalene sulfonic acid hydrazide, diphenyl-4,4′-di(sulfonylazide) and sodium bicarbonate or mixtures of sodium bicarbonate with a solid acid such as tartaric acid. The amount of foaming agent used in the process generally is in the range of from 0.1 to 20 wt. % of the resin being extruded with from 0.1 to 5.0 wt. % being the preferred range.

The attenuated foam film is then broken down into fibers. This can be accomplished by two techniques. One is to restrain the foam film from shrinkage while heating the foam alone to a point slightly below the softening point of the resin being used. This causes the attenuated foam to heat shrink and thereby disintegrate into fibers containing numerous fibrils. A convenient way of accomplishing this is to feed the film against a hot air blast which blast pulls the fibers apart. The other technique involves applying a shearing action to the foam film to break the film down into fiber containing fibrils. This is most easily accomplished by placing portions of the foamed film in a liquid which is being violently agitated such as by rapidly rotating paddles.

In accordance with the present invention the resin being extruded contains a soap. The soap makes the fibers behave better in the paper making process by improving their wettability. Thus while the presence of the soap improves the performance of resin fibers generally if offers the greatest improvement when applied to hydrocarbon fibers formed from resins such as polyethylene, polpropylene, polystyrene, etc. and blends thereof. Generally the soap is used in an amount of from 0.1 to 5 wt. % as based on the resin being extruded, with from 1.0 to 2.0 wt. % being the preferred range. Below about 1.0 wt. % and especially below 0.1 wt. % the effect of the soap becomes too small to be effective. Above about 2.0 wt. % and especially above 5.0 wt. % the soap adds no significant improvement in the wettability of the fibers and in some cases can begin to have a deleterious effect on the resin being extruded.

The soaps used are metal salts of fatty acids containing from 7 to 24 carbon atoms. Generally the metal will have a valence of 1, 2 or 3 and be above hydrogen in the electromotive series of metals. The soap should be a solid at room temperature so that it does not immediately leach out of the fibers when contacted with water. The preferred metals are aluminum, calcium, sodium and lithium.

The fibers may be used directly to form paper. However the resulting product is generally more expensive than is desired for most uses to which paper is applied. Generally the synthetic pulp produced in accordance with the present invention is blended with from 50 to 90 wt. % of natural cellulosic pulp and then wet laid to form a paper. The coarse wet laid material finds use as filter paper, paper towels, etc. However it is preferred that the coarse wet laid paper be subjected to the application of heat and pressure in order to improve the strength and surface finish thereof. For individual paper sheets a press operated at from 10 to 500 p.s.i. and 115° to 150° C for from 0.2 sec. to 5 minutes is satisfactory. For long rolls of paper heated pressure rolls are used. Generally these are heated metal rolls such as heated steel rolls operated from 2 to 200 lbs. per lineal inch pressure, from 90° to 150° C and the paper is fed at a rate of from 10 to 500 feet per minute.

The product paper finds use in the applications to which conventional paper finds use such as writing paper, bagging, packaging, wallpaper, etc. However the paper produced in accordance with the present invention finds its greatest advantage over conventional paper in the packaging area due to its improved wet strength and heat sealability.

DESCRIPTION OF THE PREFERRED EMBODIMENTS

EXAMPLE I

A 1 inch Killian extruder having a length to diameter ratio of 24:1 is equipped with a screw having a two-stage mixing head. Temperatures are measured at four points on the extruder. These are: (A) entry point of polymer pellets; (B) at the midpoint of the screw; (C) near the mixing head and (D) at the die. The die is an 8 inch slot set at 0.020 inch opening. The quench is a room temperature air stream impinging on both sides of the fibrous foam sheet at about 1 inch from the die lips. The resulting fibrous foam sheet is passed through a pair of rolls to maintain the rate of take off and is then wound up on a paper core. The mixture being extruded is prepared by shaking together 1000 g. of Dow U 660 Styron polystyrene pellets having a melt index of 5 and 20 g. of anhydrous sodium bicarbonate powder and 1.5 g. of finely powdered aluminum stearate. The temperatures along the various points along the extruder are: (A) 250° F; (B) 350° F; (C) 450° F and (D) 450° F. The throughput is at the rate of 7 lbs. per hour and the foamed film is taken up at the rate of 25 ft. per minute.

A 2.5 g. sample of the foamed film structure and 750 ml. of water are placed in a two-speed commercial type Waring blender and the blender is operated at high speed for 10 minutes. The 7.5 g. of bleached kraft paper is added to the blender and the blender is operated at high speed for an additional 10 minutes. The resulting mixture is poured into a suction filter about 6 inches in diameter to remove the water, pressed with a flat surface and air dried for a few minutes. The resulting coarse paper is then removed and dried further. The paper is then pressed at 280° F and 40,000 lbs. pressure between metal plates for 2 minutes for additional bonding. The product is a smooth white paper which can be written on with both pen and pencil, and has qualitatively good strength. The paper exhibits exceptionally good wet strength.

EXAMPLE II

Example I is repeated except 500 g. of the polystyrene is replaced with 500 g. of polypropylene having a melt index of 10 to form a 50:50 polystyrene-polypropylene blend. The take off rate is reduced to 20 feet per minute. The product paper has a smooth white appearance. It can be written on with pen or pencil and has qualitatively good strength both wet and dry.

EXAMPLE III

Example I is repeated except that 500 g. of low density polyethylene having a specific gravity of 0.92 and a melt index of 2 is substituted for 500 g. of the polystyrene to provide a 50:50 blend of polyethylene and polystyrene. The take off rate is reduced to 20 feet per minute. The product paper has a smooth white appearance. It can be written on with pen or pencil and has qualitatively good strength both wet and dry.

EXAMPLE IV

Example I is repeated except that 1000 g. of polypropylene having a melt index of 12 is substituted for the 1000 g. of polystyrene. The product paper has a smooth white appearance. It can be written on with pen or pencil and qualitatively has good strength both wet or dry.

EXAMPLE V

Example I is repeated except a blend of 500 g. of polyvinyl chloride having a melt index of 5 and 500 g. of polystyrene having a melt index of 5 is substituted for the 1000 g. of polystyrene. The temperatures used are: (A) 250° F; (B) 300° F; (C) 350° F and (D) 400° F. The take off rate is reduced to 20 feet per minute. The product paper has a smooth white appearance. It can be written on with pen or pencil and qualitatively has good strength both wet or dry.

EXAMPLE VI

Example I is repeated except a blend of 500 g. of polyE-caprolactum having a flow index number of 1 and 500 g. of polypropylene having a melt index of 10 is substituted for the 1000 g. of polystyrene. The temperature at (D) is maintained at 510° F. The take off rate is 20 feet per minute. The product paper has a smooth white appearance. It can be written on with pen or pencil and qualitatively has good strength both wet and dry.

The invention claimed is:

1. A process for producing a synthetic thermoplastic resin pulp comprising:

a. dry blending pellets or powder synthetic thermoplastic resin with 0.1 to 5.0 percent by weight of a solid soap of a metal salt of a fatty acid containing from 7 to 24 carbon atoms and wherein the metal is lithium, sodium, calcium or aluminum;

b. blending a blowing agent in the amount of from 0.1 to 20 weight percent of the resin being extruded into a blend of resin, soap, and agent to form a foamable melt;

c. melting the resulting foamable melt blend of the resin, the soap and the agent;

d. extruding the foamable melt blend into an area of reduced pressure through a heated die which lips are set from 5 to 100 mls apart;

e. immediately attenuating the molten extruded foamed sheet with attenuation at a rate of from 1.5 to 10 times the rate linear at which the melt is extruded to induce formation of fibrils; and f. breaking down said attenuated foamed sheet into short fibers containing numerous fibrils.

2. The process of claim 1 wherein said attenuated sheet of foamed resin is broken down into fibers by immersion in a liquid and applying a shearing force thereto.

3. The process of claim 1 wherein the resin is selected from the group consisting of polystyrene, polypropylene, polyethylene, polyvinyl chloride, poly-$\rho$-caprolactam and blends thereof.

4. The process of claim 1 wherein said attenuated sheet of foamed resin is broken down into fibers by restraining said sheet and heating said sheet to a temperature slightly below the softening point of the resin whereby the attenuated foamed resin sheet heat shrinks and disintegrates into the fibers.

* * * * *